US007299997B2

(12) United States Patent
Sayar

(10) Patent No.: US 7,299,997 B2
(45) Date of Patent: Nov. 27, 2007

(54) FUEL INJECTOR WITH SAUTER-MEAN-DIAMETER ATOMIZATION SPRAY OF LESS THAN 70 MICRONS

(75) Inventor: Hamid Sayar, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 45 days.

(21) Appl. No.: 10/972,652

(22) Filed: Oct. 26, 2004

(65) Prior Publication Data

US 2005/0087629 A1 Apr. 28, 2005

Related U.S. Application Data

(60) Provisional application No. 60/514,779, filed on Oct. 27, 2003.

(51) Int. Cl.
*F02D 1/06* (2006.01)

(52) U.S. Cl. ..... 239/5; 239/533.12; 239/533.2; 239/494; 239/497; 239/601; 239/598

(58) Field of Classification Search ..... 239/596, 239/494, 497, 601, 598, 533.12, 533.2
See application file for complete search history.

(56) References Cited

U.S. PATENT DOCUMENTS 1,693,931 A 12/1928 Lowe
2,493,209 A 1/1950 Simmons
4,040,396 A 8/1977 Tomita
4,826,131 A * 5/1989 Mikkor ..... 251/129.17
5,383,597 A * 1/1995 Sooriakumar et al. ..... 239/5
5,586,726 A 12/1996 Furuya et al.
5,662,277 A * 9/1997 Taubitz et al. ..... 239/585.4
6,065,691 A 5/2000 West
6,065,692 A 5/2000 Brinn, Jr.
6,089,473 A * 7/2000 Keim ..... 239/533.12
6,102,299 A 8/2000 Pace et al.
6,161,782 A 12/2000 Heinbuck et al.
6,357,677 B1 3/2002 Ren et al.
2003/0234302 A1 12/2003 Varble et al.

OTHER PUBLICATIONS

Malvern Products, Spraytec Droplet Size Analyzer, www.malvern.co.uk, Oct. 19, 2004, pp. 1-3.

* cited by examiner

*Primary Examiner*—Dinh Q Nguyen

(57) ABSTRACT

A fuel injector is shown and described. The fuel injector includes an inlet, outlet, seat, closure member, and a metering orifice disc. The metering orifice disc is disposed between the seat and the outlet. The metering orifice disc includes a plurality of metering orifices disposed about the longitudinal axis and a flow channel to each metering orifice disc so that, when the inlet of the fuel injector is provided with a pressurized fluid over a range of pressure from 200 kiloPascals to 600 kiloPascals and the closure member is actuated to the first position, the metering orifice disc provides an atomized fluid having a Sauter-Mean-Diameter of less than 70 microns proximate the outlet of the fuel injector. A method of atomizing is also provided.

18 Claims, 5 Drawing Sheets

FUEL INJECTOR WITH SAUTER-MEAN-DIAMETER ATOMIZATION SPRAY OF LESS THAN 70 MICRONS

This application claims the benefits of U.S. provisional patent application Ser. No. 60/514,779 entitled "Fluidic Flow Controller Orifice Disc," filed on 27 Oct. 2003 , which provisional patent application is incorporated herein by reference in its entirety into this application.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electromagnetic fuel injector typically utilizes a solenoid assembly to supply an actuating force to a fuel metering assembly. Typically, the fuel metering assembly is a plunger-style closure member which reciprocates between a closed position, where the closure member is seated in a seat to prevent fuel from escaping through a metering orifice into the combustion chamber, and an open position, where the closure member is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration. Thus, it is believed that there is a need in the art for a fuel injector that would alleviate the drawbacks of the conventional fuel injector in providing spray targeting and atomizing of fuel flow with minimal modification of a fuel injector.

SUMMARY OF THE INVENTION

The present invention provides a fuel injector that includes an inlet, outlet, seat, closure member, and a metering orifice disc. The inlet and outlet include a passage extending along a longitudinal axis from the inlet to the outlet, the inlet being communicable with a flow of fuel. The seat is disposed in the passage proximate the outlet. The seat includes a sealing surface that faces the inlet and a seat orifice extending through the seat from the sealing surface along the longitudinal axis A-A. The closure member is reciprocally located between a first position displaced from the seat, and a second position contiguous the sealing seat surface of the seat to form a seal that precludes fuel flow past the closure member. The metering orifice disc is disposed between the seat and the outlet. The metering orifice disc includes a plurality of metering orifices disposed about the longitudinal axis and a flow channel to each metering orifice disc so that, when the inlet of the fuel injector is provided with a pressurized fluid over a range of pressure from 300 kiloPascals to 400 kiloPascals and the closure member is actuated to the first position, the metering orifice disc provides an atomized fluid having a Sauter-Mean-Diameter of less than 70 microns proximate the outlet of the fuel injector.

In yet another aspect, a method of atomizing fuel flow through at least one metering orifice of a fuel injector is provided. The fuel injector includes an inlet, outlet and a passage extending along a longitudinal axis therethrough the inlet and outlet. The outlet has a seat and a metering orifice disc. The seat has a seat orifice and a closure member that occludes a flow of fuel through seat orifice. The metering orifice disc is disposed between the seat and the outlet. The metering orifice disc includes at least one metering orifice. The method can be achieved by: flowing fuel away from the longitudinal axis to the at least one metering orifice through two flow channels, each flow channel having a first cross-sectional area greater than a second cross-sectional area proximate the metering orifice; and impacting the flow of fuel through the two channels proximate the metering orifice to atomize the fuel proximate the outlet.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1A:
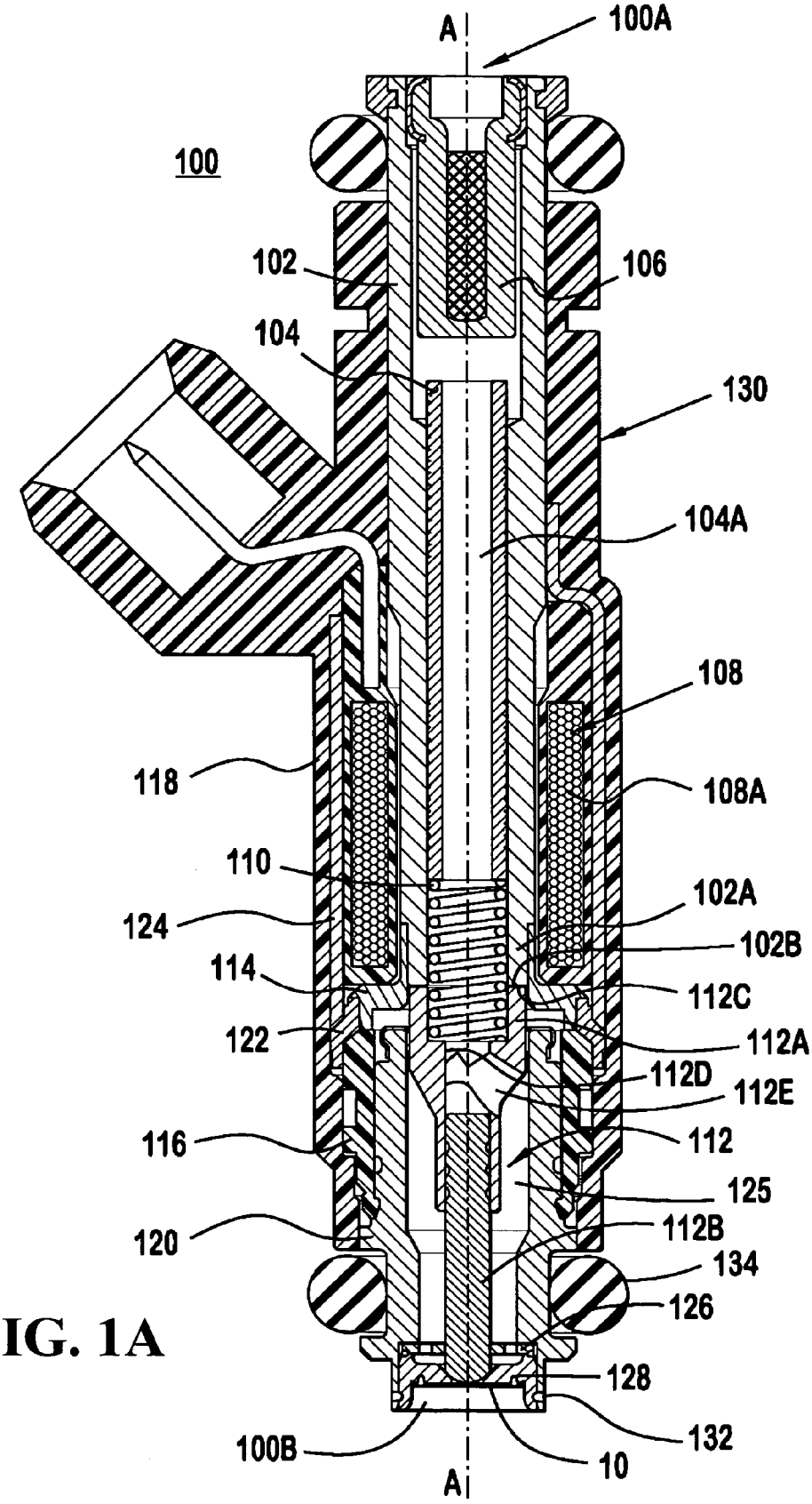
FIG. 1A illustrates a cross-sectional view of the fuel injector for use with the metering orifice discs of FIGS. 2 and 3.
Figure 1B:
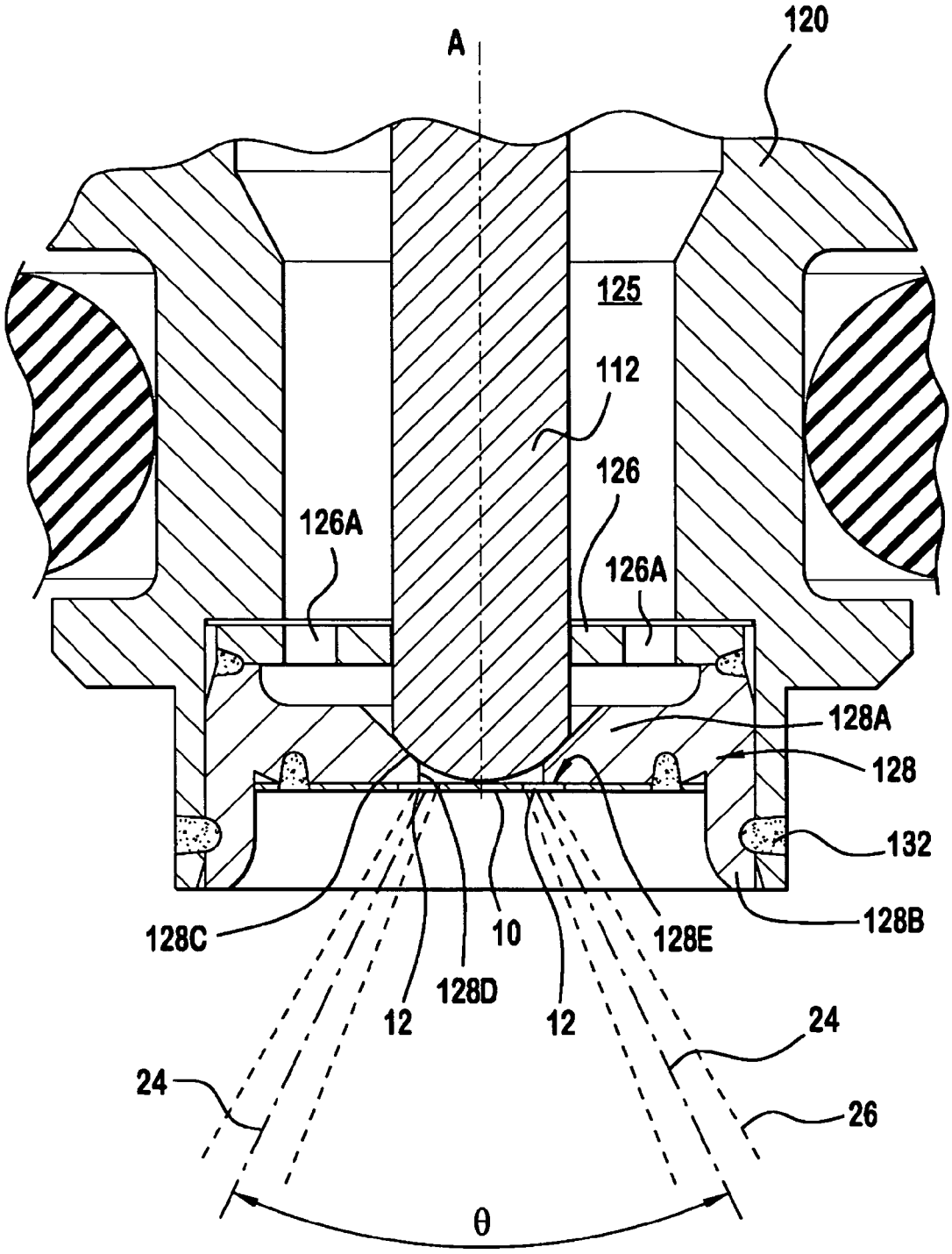
FIG. 1B illustrates a close-up cross-sectional view of the fuel outlet end of the fuel injector of FIG. 1A.
Figure 2:
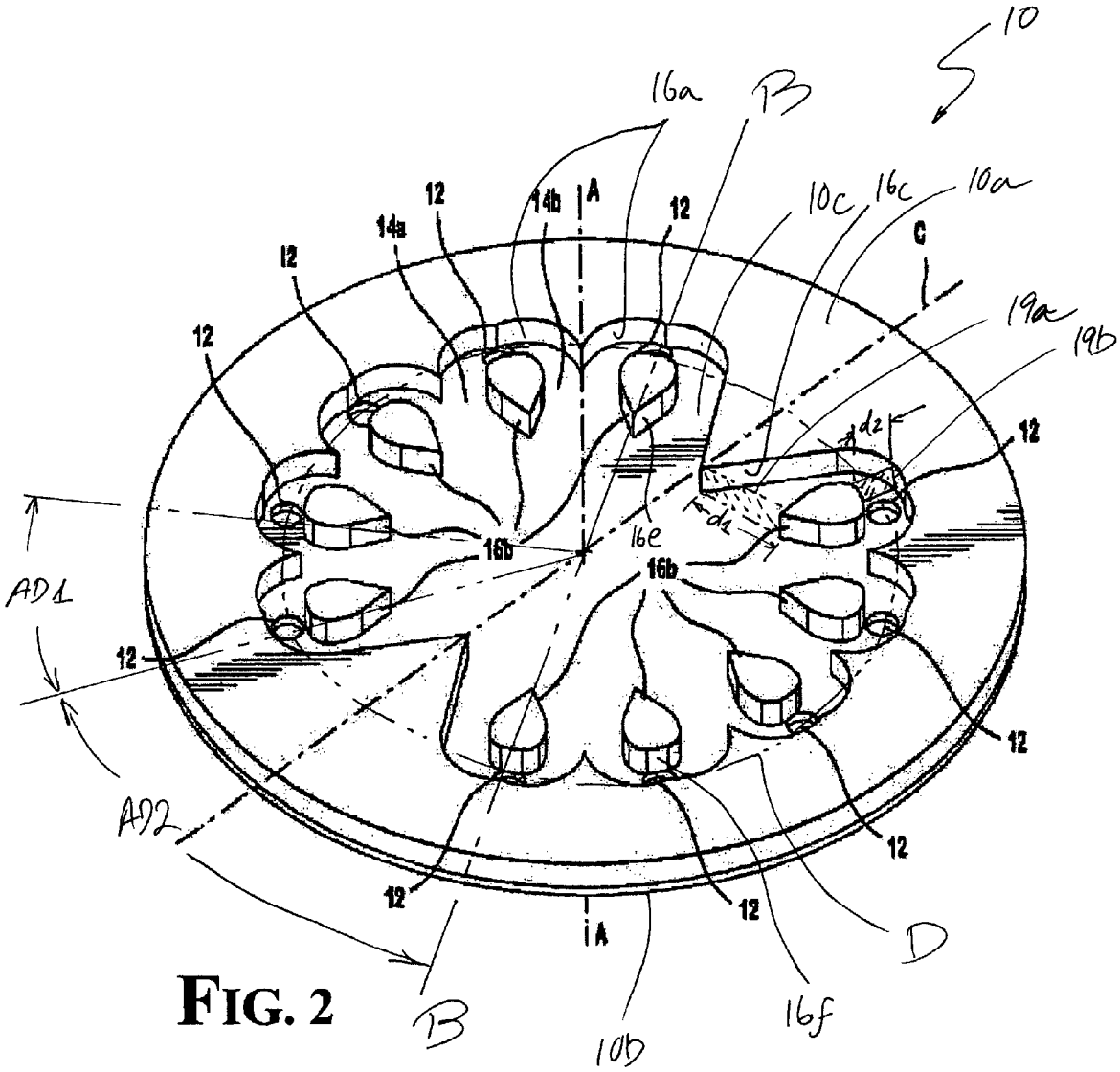
FIG. 2 illustrates a perspective view of a preferred embodiment of a metering orifice disc for use in a fuel injector.
Figure 3:
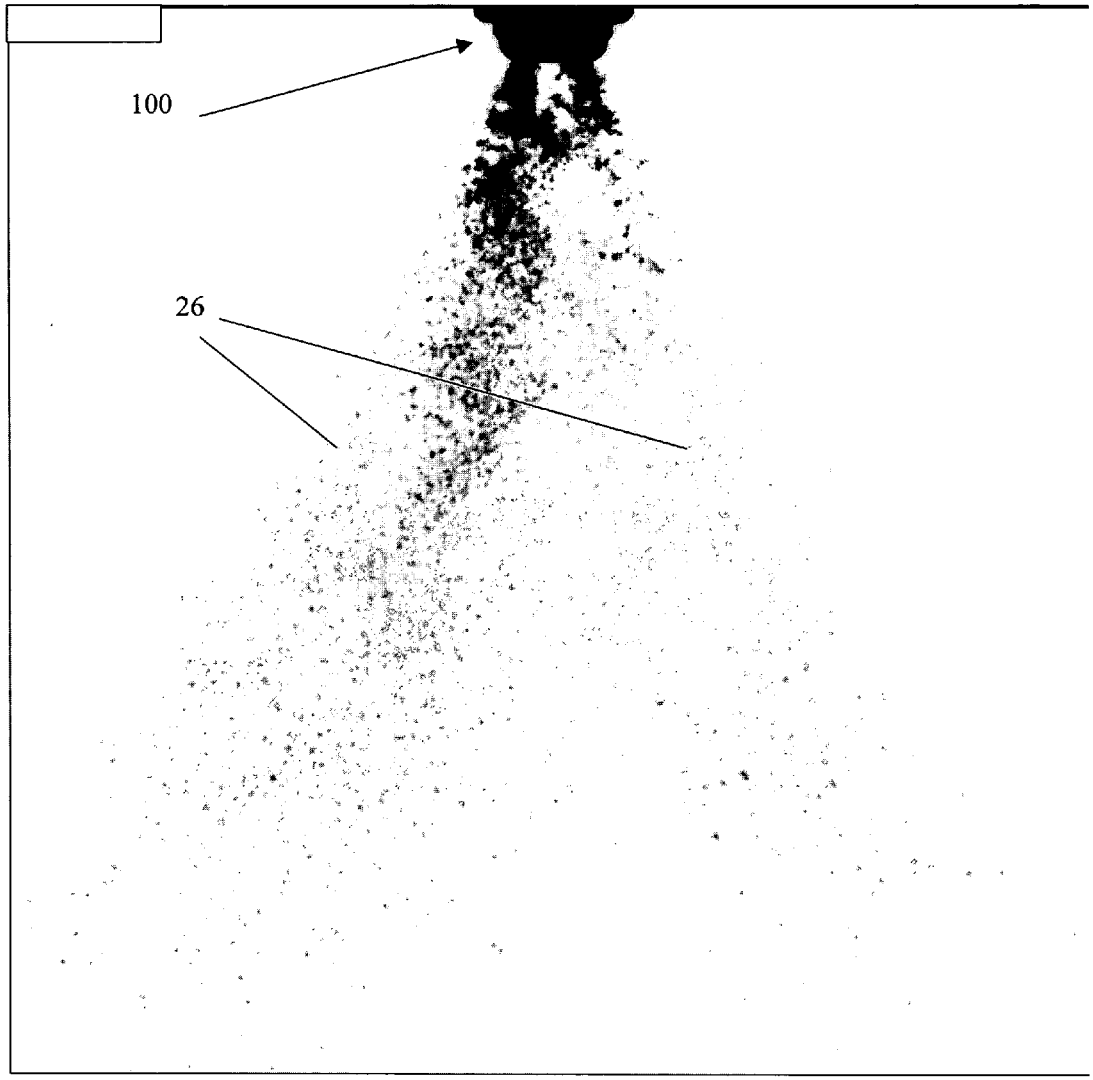
FIG. 3 is a photograph of a fuel spray from the outlet of the fuel injector of FIG. 1 that provides an approximate visual indicator of the fuel droplet sizes in the fuel spray.
Figure 4:
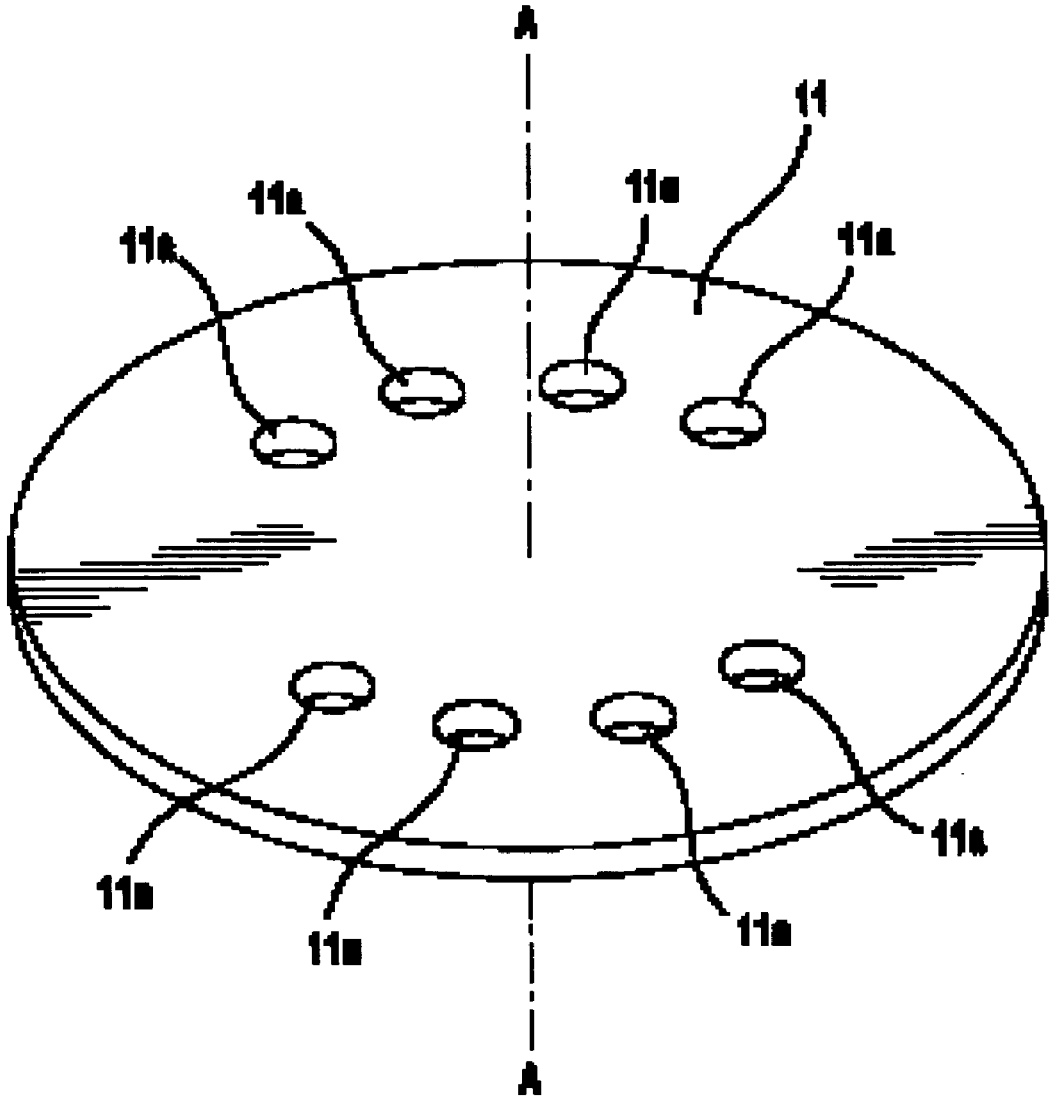
FIG. 4 illustrates a baseline metering orifice disc without the channels and dividers of FIGS. 2 and 3.

FIGS. 1-3 illustrate the preferred embodiments, including, as illustrated in FIG. 1A, a fuel injector 100 that utilizes a metering orifice disc 10 located proximate the outlet of the fuel injector 100.

As shown in FIG. 1A, the fuel injector 100 has a housing that includes an inlet tube 102, adjustment tube 104, filter assembly 106, coil assembly 108, biasing spring 110, armature assembly 112 with an armature 112A and closure member 112B, non-magnetic shell 114, a first overmold 116, second overmold 118, a body 120, a body shell 122, a coil assembly housing 124, a guide member 126 for the closure member 112A, a seat assembly 128, and the metering orifice disk 10.

Armature assembly 112 includes a closure member 112A. The closure member 112A can be a suitable member that provides a seal between the member and a sealing surface 128C of the seat assembly 128 such as, for example, a spherical member or a closure member with a hemispherical surface. Preferably, the closure member 112A is a closure member with a generally hemispherical end. The closure member 112A can also be a one-piece member of the armature assembly 112.

Coil assembly 120 includes a plastic bobbin on which an electromagnetic coil 122 is wound. Respective terminations of coil 122 connect to respective terminals that are shaped and, in cooperation with a surround 118A, formed as an integral part of overmold 118, to form an electrical connector for connecting the fuel injector 100 to an electronic control circuit (not shown) that operates the fuel injector 100.

Inlet tube 102 can be ferromagnetic and includes a fuel inlet opening at the exposed upper end. Filter assembly 106 can be fitted proximate to the open upper end of adjustment tube 104 to filter any particulate material larger than a certain size from fuel entering through inlet opening 100A before the fuel enters adjustment tube 104.

In the calibrated fuel injector 100, adjustment tube 104 can be positioned axially to an axial location within inlet tube 102 that compresses preload spring 110 to a desired bias force. The bias force urges the armature/closure to be seated on seat assembly 128 so as to close the central hole through the seat. Preferably, tubes 110 and 112 are crimped together to maintain their relative axial positioning after adjustment calibration has been performed.

After passing through adjustment tube 104, fuel enters a volume that is cooperatively defined by confronting ends of inlet tube 102 and armature assembly 112 and that contains preload spring 110. Armature assembly 112 includes a passageway 112E that communicates volume 125 with a passageway 104A in body 130, and guide member 126 contains fuel passage holes 126A. This allows fuel to flow from volume 125 through passageways 112E to seat assembly 128, shown in the close-up of FIG. 1B.

In FIG. 1B, the seat assembly 128 includes a seat body 128A with a seat extension 128B. The seat extension 128B can be coupled to the body 120 with a weld 132 that is preferably welded from an outer surface of the body 120 to the seat extension 128B. The seat body 128A is coupled to a guide disc 126 with flow openings 126A. The seat body 128A includes a seat orifice 128D, preferably having a right-angle cylindrical wall surface with a generally planar face 128E at the bottom of the seat body 128A. The seat body 128A is coupled to the metering orifice disc 10 by a suitable attachment technique, preferably by a weld extending from the second surface 10B of the disc 10 through first surface 10A and into the generally planar face 128E of the seat body 128A. The guide disk 126, seat body 128A and metering orifice disc 10 can form the seat assembly 128, which is coupled to the body 120. Preferably, the seat body 128A and the metering orifice disc 10 form the seat assembly 128. It should be noted here that both the valve seat assembly 128 and metering orifice disc 10 can be attached to the body 120 by a suitable attachment technique, including, for example, laser welding, crimping, and friction welding or conventional welding.

Referring back to FIG. 1A, non-ferromagnetic shell 114 can be telescopically fitted on and joined to the lower end of inlet tube 102, as by a hermetic laser weld. Shell 114 has a tubular neck that telescopes over a tubular neck at the lower end of inlet tube 102. Shell 114 also has a shoulder that extends radially outwardly from neck. Body shell 122 can be ferromagnetic and can be joined in fluid-tight manner to non-ferromagnetic shell 114, preferably also by a hermetic laser weld.

The upper end of body 130 fits closely inside the lower end of body shell 122 and these two parts are joined together in fluid-tight manner, preferably by laser welding. Armature assembly 112 can be guided by the inside wall of body 130 for axial reciprocation. Further axial guidance of the armature/closure member assembly can be provided by a central guide hole in member 126 through which closure member 112A passes. Surface treatments can be applied to at least one of the end portions 102B and 112C to improve the armature's response, reduce wear on the impact surfaces and variations in the working air gap between the respective end portions 102B and 112C.

According to a preferred embodiment, the magnetic flux generated by the electromagnetic coil 108A flows in a magnetic circuit that includes the pole piece 102A, the armature assembly 112, the body 120, and the coil housing 124. The magnetic flux moves across a side airgap between the homogeneous material of the magnetic portion or armature 112A and the body 120 into the armature assembly 112 and across a working air gap between end portions 102B and 112C towards the pole piece 102A, thereby lifting the closure member 112B away from the seat assembly 128. Preferably, the width of the impact surface 102B of pole piece 102A is greater than the width of the cross-section of the impact surface 112C of magnetic portion or armature 112A. The smaller cross-sectional area allows the ferromagnetic portion 112A of the armature assembly 112 to be lighter, and at the same time, causes the magnetic flux saturation point to be formed near the working air gap between the pole piece 102A and the ferro-magnetic portion 112A, rather than within the pole piece 102A.

The first injector end 100A can be coupled to the fuel supply of an internal combustion engine (not shown). The O-ring 134 can be used to seal the first injector end 100A to the fuel supply so that fuel from a fuel rail (not shown) is supplied to the inlet tube 102, with the O-ring 134 making a fluid tight seal, at the connection between the injector 100 and the fuel rail (not shown).

In operation, the electromagnetic coil 108A is energized, thereby generating magnetic flux in the magnetic circuit. The magnetic flux moves armature assembly 112 (along the axis A-A, according to a preferred embodiment) towards the integral pole piece 102A, i.e., closing the working air gap.

This movement of the armature assembly 112 separates the closure member 112B from the sealing surface 128C of the seat assembly 128 and allows fuel to flow from the fuel rail (not shown), through the inlet tube 102, passageway 104A, the through-bore 112D, the apertures 112E and the body 120, between the seat assembly 128 and the closure member 112B, through the opening, and finally through the metering orifice disc 10 into the internal combustion engine (not shown). When the electromagnetic coil 108A is de-energized, the armature assembly 112 is moved by the bias of the resilient member 226 to contiguously engage the closure member 112B with the seat assembly 128, and thereby prevent fuel flow through the injector 100.

Referring to FIG. 2, a perspective view of a preferred metering orifice 10 is illustrated. Disk 10 includes a first metering disk surface 10A and an oppositely facing second metering disk surface 10B. A longitudinal axis A-A extends through both surfaces 10A and 10B of the metering orifice disc 10. A plurality of metering orifices 12 is formed through the metering orifice disc 10 on a recessed third surface 10C. The metering orifices 12 are preferably located radially outward of the longitudinal axis along a first virtual circle D shown in phantom, and extend through the metering orifice disc 10 along the longitudinal axis so that the internal wall surface of the metering orifice 12 defines a center 12*a* of the metering orifice 12. In an exemplary embodiment, the plurality of metering orifices 12 correspond to a metering orifice having an effective through-opening diameter of about 100 to 200 microns. Although the metering orifices 12 are illustrated preferably as having the same configuration, other configurations are possible such as, for example, a non-circular flow opening with different sizes of the flow opening for one or more metering orifices. As shown in FIG. 2, at least two of the metering orifices 12 are diametrically disposed on the first virtual circle D about the longitudinal axis A-A. At least two of the metering orifices 12 are disposed at a first arcuate distance AD1 relative to each other, and at least three of the metering orifices 12 (four are shown in FIG. 2) are disposed at a second arcuate distance AD2 relative to each other.

The metering orifice disk 10 includes two flow channels 14A and 14B provided by two walls 16A and 16B. A first wall 16A surrounds the metering orifices 12. A second wall 16B, acting as a flow divider, is disposed between each metering orifice and the longitudinal axis A-A. The first wall 16A surrounds at least one metering orifice and at least the second wall 16B. The second wall 16B is preferably in the form of a teardrop shape but can be any suitable shape as long as the second wall 16B divides a fuel flow proximate the longitudinal axis A-A into two flow channels 14A and 14B and recombine the fuel flow proximate the metering orifice 12 at a higher velocity than as compared to the velocity of the fuel at the beginning of the second wall 16B. The first wall 16A includes a first inner wall portion 16*c* closest to the longitudinal axis A-A and a first outer wall portion 16*d* closest to the center of the metering orifice 12. The second wall 16B includes a second inner wall portion 16*e* furthest from the center of the metering orifice 12 and a second outer wall portion 16*f* closest to the center of the metering orifice 12. The second wall 16B confronts the first wall 16A to define a first distance d1 between the first inner wall portion 16*c* and second inner wall portion 16*e* being greater than a second distance d2 between the first outer wall portion 16*d* and second outer wall portion 16*f*. The two flow channels 14A, 14B thus define a first cross-sectional area 19*a* greater than a second cross-sectional area 19*b* proximate to each metering orifice 12.

The metering orifice disc 10 can be made by any suitable technique and preferably by at least two techniques. The first technique utilizes laser machining to selectively remove materials on the surface of the metering orifice disc 10. The second technique utilizes chemical etching to dissolve portions of the metallic surface of the metering orifice disc 10.

The techniques of making the metering orifice disc or valve seat, the detail of various flow channels and divider configurations for various metering discs or valve seats are provided in copending applications Ser. Nos. 10/972,584; 10/972,585; 10/972,583; 10/972,864; 10/972,651, the entirety of which are incorporated by reference.

It has been discovered that the various metering orifice discs 10 described herein were able to provide for increased atomization of fuel flowing through fuel spray axis 24 proximate the outlet of the fuel injector 100 to define a fuel cloud of atomized fuel 26 (FIG. 3). As is known, atomization of fuel by a fuel injector under actual operating conditions can be predicted by using a suitable test fluid such as, for example, N-Heptane. The atomization of the test fluid from any fuel injector can be empirically measured by a technique known as Laser Diffraction with a SPRAYTEC® machine manufactured by the Malvern Instrument Company® of United Kingdom. This empirical measurement is believed to be a highly accurate predictor of the atomization of various types of fuel under actual operating conditions of the fuel injector 100 in an internal combustion engine such as, for example, a fuel pressure from 200 to 600 kiloPascals at various fuel flow rates from about 0.5 to about 5 grams per second through the fuel injector.

When such technique is used to quantify the average size of the test fluid droplets, i.e., a Sauter-Mean-Diameter, it was discovered that the Sauter-Mean-Diameter of the droplet size of the atomized fluid 26 (provided by the preferred embodiments in FIG. 2 or at least one metering discs disclosed in any of the copending applications referenced above) is less than 72 microns and consistently about 50 microns with the fuel pressure being from about 300 to 400 kPa, at a test flow rate from 0.9 to 2.6 grams per second through the fuel injector. In contrast, a baseline metering orifice disc 11 (with metering orifices 11A, shown here in FIG. 8), without the flow channels, recessed surface and flow dividers, was unable to provide a flow spray with a Sauter-Mean-Diameter of less than 72 microns at generally similar fluid pressures and flow rates. For example, the baseline disc 11 was tested with a fluid flow rate of 2 grams per second through the fuel injector at about 300 kPa that resulted in a Sauter-Mean-Diameter of this baseline disc of about 75 microns. It is believed that applicant's preferred fuel injector is the first to achieve a Sauter-Mean-Diameter of about 50 microns under the test conditions described above.

As described, the preferred embodiments, including the techniques of atomizing fuel are not limited to the fuel injector disclosed herein but can be used in conjunction with other fuel injectors such as, for example, the fuel injector sets forth in U.S. Pat. No. 5,494,225 issued on Feb. 27, 1996, or the modular fuel injectors set forth in U.S. Pat. Nos. 6,676,044 and 6,793,162, and wherein all of these U.S. Patents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims.

Accordingly, it is intended that the present invention not be limited to the described embodiments, but that it has the full scope defined by the language of the following claims, and equivalents thereof.

What I claim is:

1. A fuel injector comprising:

an inlet and an outlet and a passage extending along a longitudinal axis from the inlet to the outlet, the inlet communicable with a flow of fuel;

a seat disposed in the passage proximate the outlet, the seat including a sealing surface that faces the inlet and a seat orifice extending through the seat from the sealing surface along the longitudinal axis;

a closure member being reciprocally located between a first position displaced from the seat, and a second position contiguous the sealing seat surface of the seat to form a seal that precludes fuel flow past the closure member; and a metering orifice disc disposed between the seat and the outlet, the metering orifice disc comprising a plurality of metering orifices located radially outward of the seat orifice and extending through the orifice disc from a surface recessed relative to a top end of the orifice disc, a wall disposed proximate to each metering orifice and outwardly thereof relative to the longitudinal axis, and a flow divider disposed between each metering orifice and the longitudinal axis, the wall and the flow divider defining a pair of converging flow channels to each metering orifice transverse to the longitudinal axis, the flow channels combining proximate to each metering orifice so that, when the inlet of the injector is provided with a pressurized fluid over a range of pressure from 200 kiloPascals to 600 kiloPascals and the closure member is actuated to the first position, the metering orifice disc provides an atomized fluid having a Sauter-Mean-Diameter of less than 70 microns proximate the outlet of the fuel injector.

2. The fuel injector of claim 1, wherein the fluid comprises N-heptane provided at a flow rate of about 2 grams per second through the fuel injector at a fluid pressure fed to the inlet of about 300 kiloPascals, and the Sauter-Mean-Diameter of the atomized fluid provided by the metering orifice disc proximate the outlet of the fuel injector is less than 60 microns.

3. The fuel injector of claim 2, wherein the plurality of metering orifices comprises a metering orifice having an effective through-opening diameter of about 100 to about 200 microns.

4. The fuel injector of claim 1, wherein the range of pressures comprises from 200 to 325 kiloPascals over a range of flow rates from 0.9 to 2.6 grams per second through the fuel injector.

5. The fuel injector of claim 1, wherein the at least one flow channel comprises two flow channels for each metering orifice.

6. The fuel injector of claim 1, wherein the flow divider comprises a second wall having a portion that extends from the recessed surface of the metering orifice disc towards the seat orifice.

7. The fuel injector of claim 6, wherein the portion comprises a generally circular portion disposed within a virtual projection of the seat orifice onto the generally planar surface of the metering orifice disc.

8. The fuel injector of claim 1, wherein the metering orifice disc comprises a generally circular stainless steel disc having an outer diameter of about 5.5 millimeters and a thickness of about 400 microns.

9. The fuel injector of claim 6, wherein the metering orifice disc comprises a generally circular stainless steel disc having an outer diameter of about 5.5 millimeters and a thickness of about 400 microns.

10. The fuel injector of claim 1, wherein the plurality of metering orifices includes at least two metering orifices diametrically disposed on a first virtual circle about the longitudinal axis A-A.

11. The fuel injector of claim 10, wherein the plurality of metering orifices includes at least two metering orifices disposed at a first arcuate distance relative to each other on the first virtual circle.

12. The fuel injector of claim 10, wherein the plurality of metering orifices includes at least three metering orifices spaced at different arcuate distances on the first virtual circle.

13. The fuel injector of claim 1, wherein the metering orifice disc comprises:

a disc surface confronting a seat surface disposed about the seat orifice, the plurality of metering orifices being located about the longitudinal axis outside a virtual projection of a sealing surface of the seat onto the disc surface of the metering orifice disc; and a divider interposed between the disc and seat surfaces and between each metering orifice and the seat orifice.

14. The fuel injector of claim 13, wherein the divider defines at least two flow channels for each metering orifice.

15. The fuel injector of claim 13, wherein the flow channels are symmetric about an axis that extends from the longitudinal axis to a center of a metering orifice.

16. The fuel injector of claim 13, wherein the flow channels are asymmetric about an axis that extends from the longitudinal axis to a center of a metering orifice.

17. A method of atomizing fuel flow through at least one metering orifice of a fuel injector, the fuel injector having an inlet and an outlet and a passage extending along a longitudinal axis therethrough, the outlet having a seat and a metering orifice disc, the seat having a seat orifice, a closure member that occludes a flow of fuel through seat orifice in one position and permits flow in another position, the metering orifice disc being disposed between the seat and the outlet, the metering orifice disc including at least one metering orifice having a perimeter, the method comprising:

flowing first and second portions of the fuel away from the longitudinal axis to the at least one metering orifice through two respective flow channels that converge towards the at least one metering orifice, the flow channels combining proximate to the at least one metering orifice, each flow channel having a first cross-sectional area greater closer to the longitudinal axis than a second cross-sectional area proximate the at least one metering orifice; and impacting the first and second portions of fuel against each other at the perimeter of the at least one metering orifice.

18. The method of claim 17, wherein the flowing comprises pressurizing fuel to the inlet of the fuel injector at 300 kiloPascals at a flow rate of about 2 grams per second through the fuel injector and actuating the closure member to the another position.

* * * * *